US007657954B1

(12) United States Patent
Bunkers

(10) Patent No.: US 7,657,954 B1
(45) Date of Patent: Feb. 9, 2010

(54) HEAD AND FACE COVERING APPARATUS

(76) Inventor: Gwen Bunkers, 4804 S. Yellowstone Cir., Sioux Falls, SD (US) 57108

( * ) Notice: Subject to any disclaimer, the term of this patent is extended or adjusted under 35 U.S.C. 154(b) by 0 days.

(21) Appl. No.: 12/337,313

(22) Filed: Dec. 17, 2008

(51) Int. Cl.
*A47G 9/00* (2006.01)
*A42B 1/00* (2006.01)
*A42B 1/08* (2006.01)

(52) U.S. Cl. ..... 5/644; 5/636; 5/639; 2/202

(58) Field of Classification Search ..... 5/636, 5/644, 640, 490, 639; 2/202
See application file for complete search history.

(56) References Cited

U.S. PATENT DOCUMENTS

| | | | | |
|---|---|---|---|---|
| 3,840,918 | A | 10/1974 | Shave | |
| D270,320 | S | 8/1983 | Smith | |
| 4,420,847 | A | 12/1983 | Smith | |
| 4,887,319 | A | 12/1989 | Daniels | |
| 5,127,117 | A | 7/1992 | Bridges | |
| 5,572,753 | A | 11/1996 | Ruscitto | |
| 6,233,767 | B1 * | 5/2001 | Horowitz | 5/644 |
| 6,363,554 | B1 | 4/2002 | Brown | |
| 6,523,200 | B2 | 2/2003 | Brown | |
| 6,651,256 | B1 | 11/2003 | Swift | |
| 6,892,406 | B2 | 5/2005 | Littlehorn | |
| 7,428,763 | B2 * | 9/2008 | Hightower | 5/636 |

* cited by examiner

*Primary Examiner*—Alexander Grosz

(57) ABSTRACT

A head and face covering apparatus includes a flexible housing that defines a pillow case and is U-shaped. The housing includes a central portion and a pair of arms extending away from the central portion. The housing has an elongated opening therein. A pillow is removably extendable into the housing through the opening. A flexible head covering is attached to the housing and extends upwardly therefrom. The head covering includes a rear wall, a pair of lateral walls, and a top wall. The top and lateral walls form a continuous front edge defining an opening extending into a front side of the head covering. The rear and lateral walls are attached to the housing. The head covering has an internal volume greater than 1.0 cubic feet to allow a person's face to be encapsulated by the head covering when the person abuts their head against the rear wall.

3 Claims, 6 Drawing Sheets

HEAD AND FACE COVERING APPARATUS

BACKGROUND OF THE DISCLOSURE

Field of the Disclosure

The disclosure relates to face covering devices and more particularly pertains to a new face covering device for allowing a person to cover and shield their face while in a sitting position such as in a seat of an aircraft.

SUMMARY OF THE DISCLOSURE

An embodiment of the disclosure meets the needs presented above by generally comprising a flexible housing that defines a pillow case and is U-shaped. The housing includes a central portion and a pair of arms extending away from the central portion. The housing has an elongated opening therein to access interior of the housing. A pillow is removably extendable into the housing through the opening. A flexible head covering is attached to the housing and extends upwardly therefrom. The head covering includes a rear wall, a pair of lateral walls, and a top wall. The top and lateral walls form a continuous front edge defining an opening extending into a front side of the head covering. The rear and lateral walls are attached to the housing. The head covering has an internal volume greater than 1.0 cubic feet to allow a person's face to be encapsulated by the head covering when the person abuts their head against the rear wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
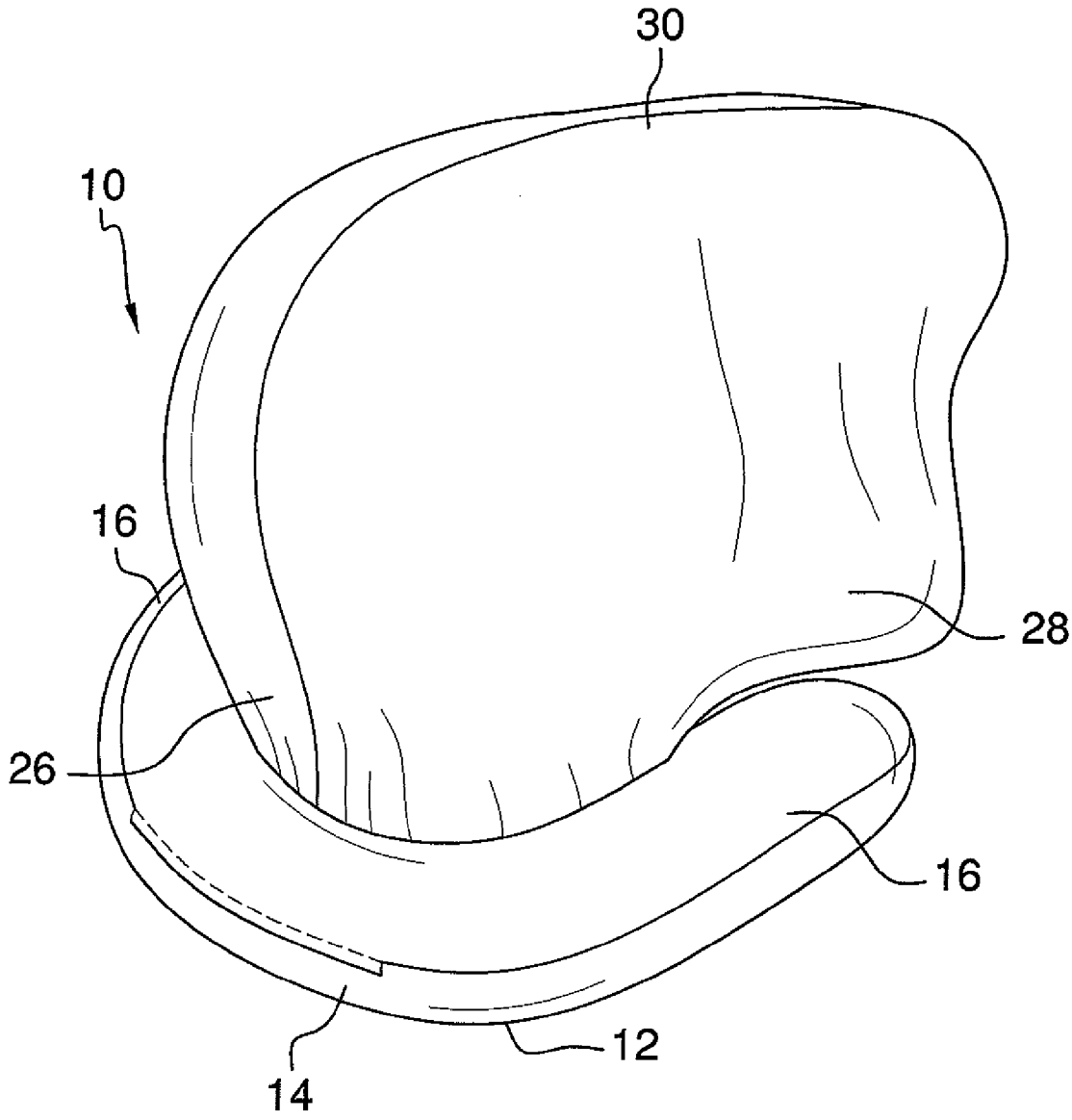
FIG. 1 is a rear perspective view of a head and face covering apparatus according to an embodiment of the disclosure.
Figure 2:
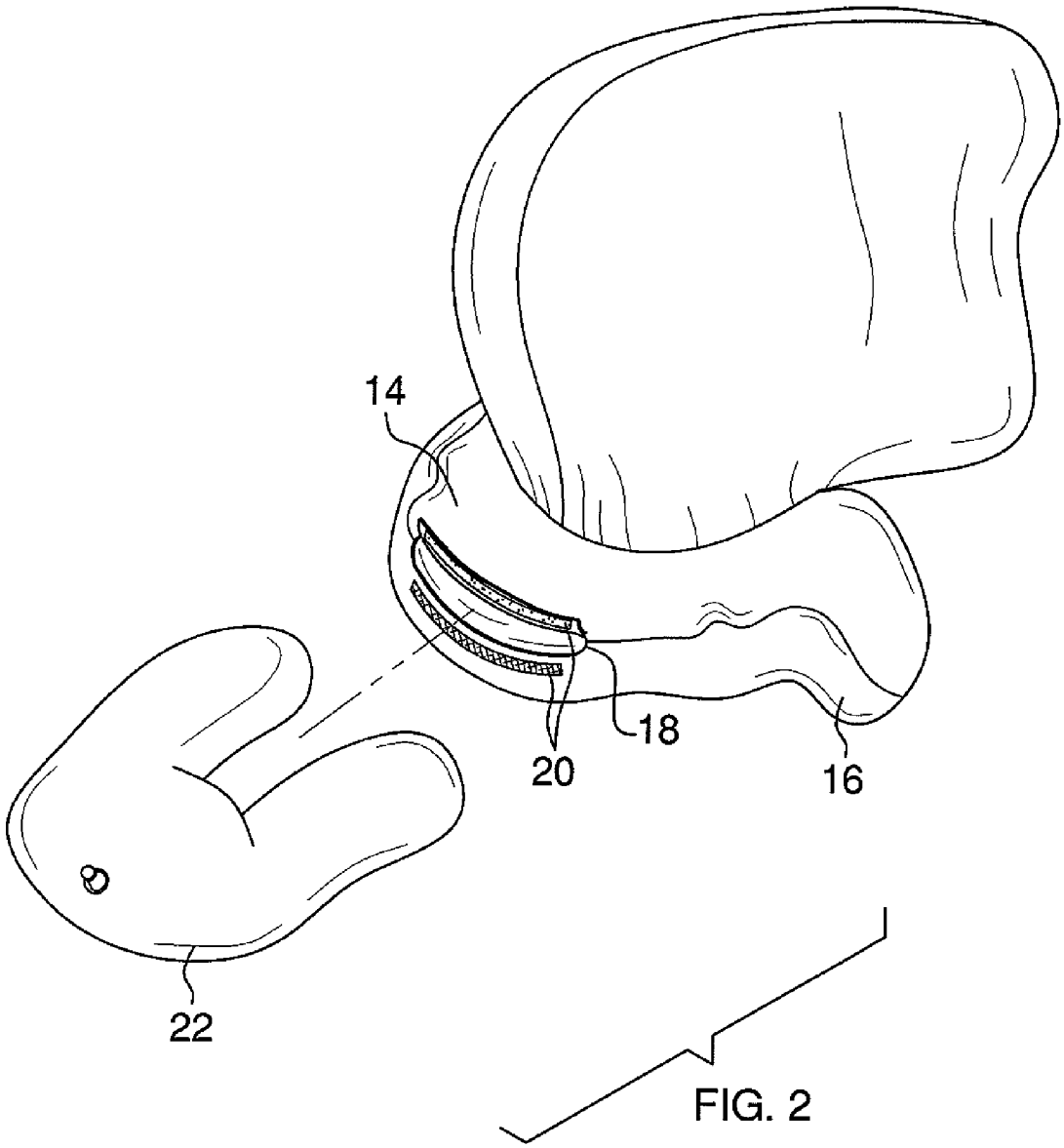
FIG. 2 is a rear perspective view of an embodiment of the disclosure.
Figure 3:
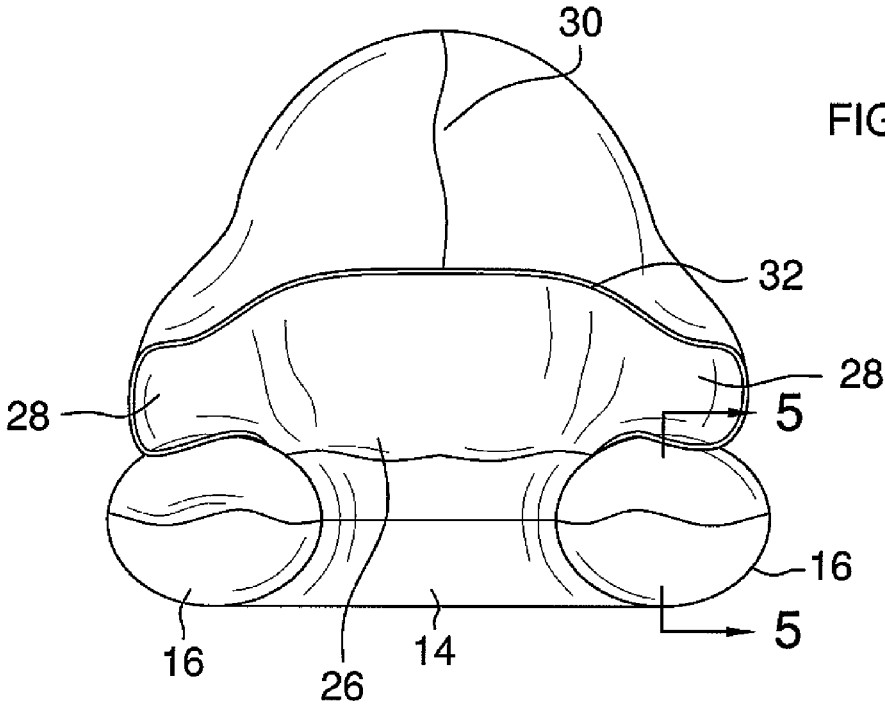
FIG. 3 is a front view of an embodiment of the disclosure.
Figure 4:
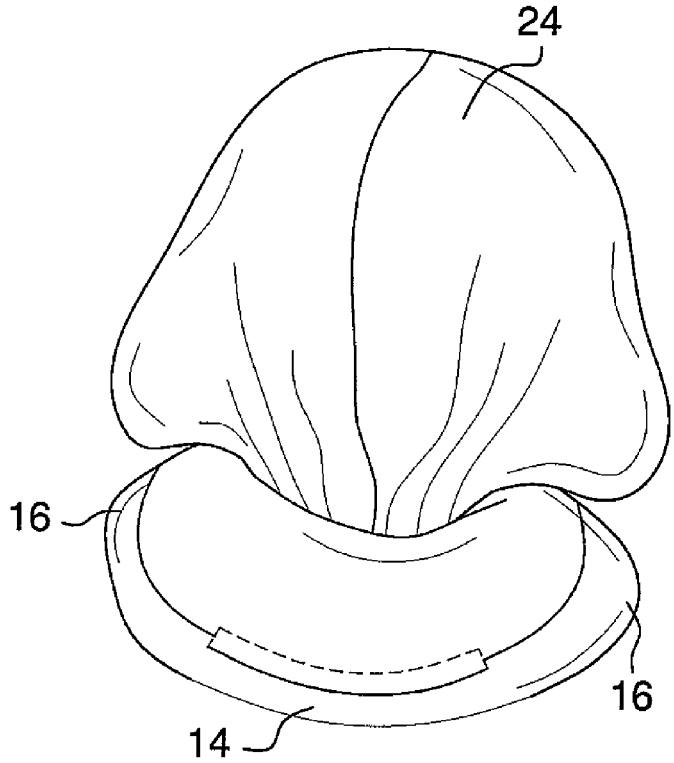
FIG. 4 is a rear view of an embodiment of the disclosure.
Figure 5:
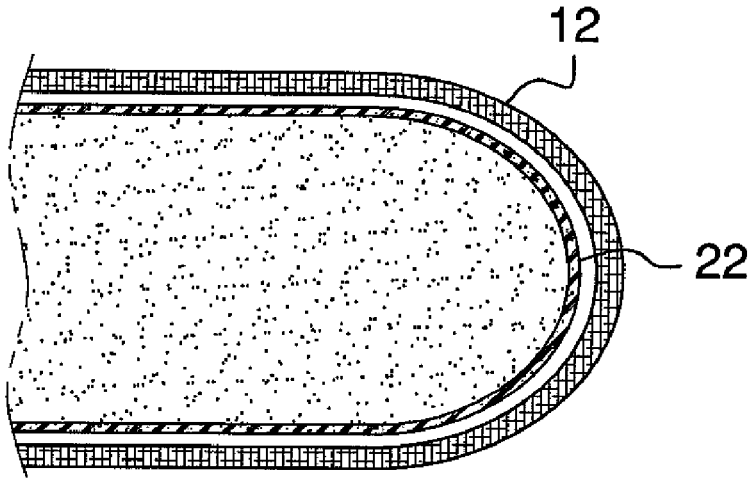
FIG. 5 is a cross-sectional view taken along line 5-5 of FIG. 3 of an embodiment of the disclosure.
Figure 6:
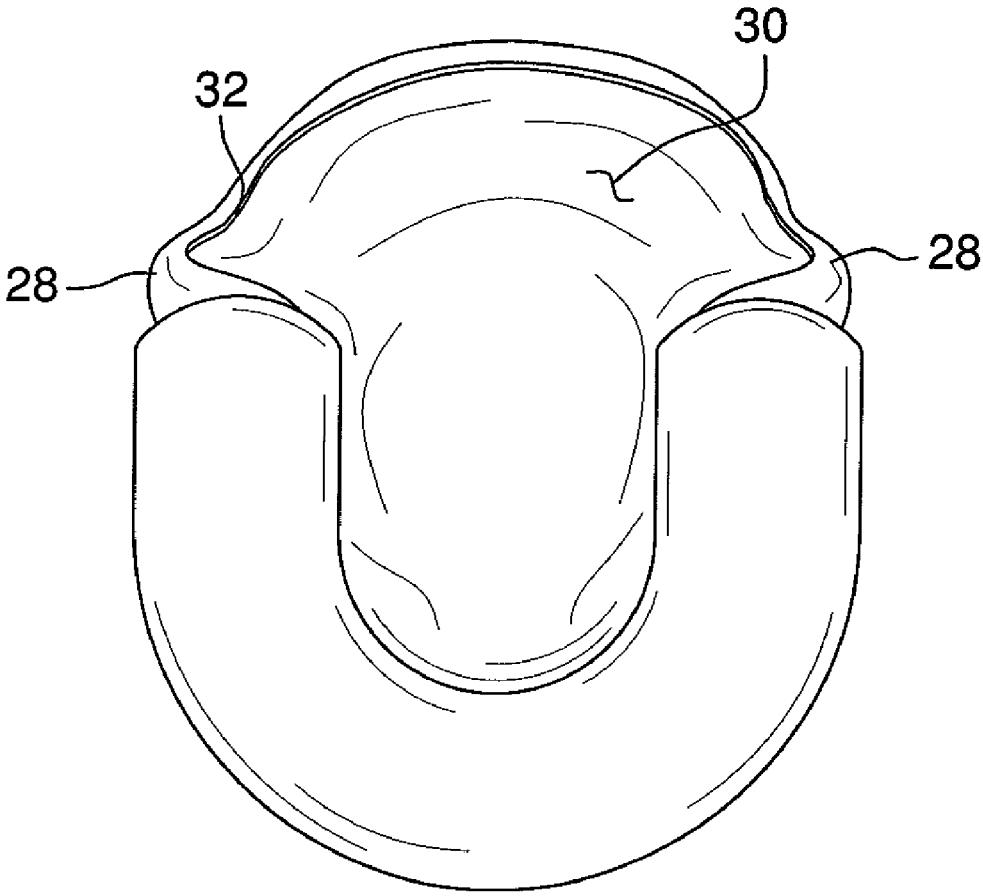
FIG. 6 is a bottom view of an embodiment of the disclosure.

With reference now to the drawings, and in particular to FIGS. 1 through 8 thereof, a new face covering device embodying the principles and concepts of an embodiment of the disclosure and generally designated by the reference numeral 10 will be described.

As best illustrated in FIGS. 1 through 8, the head and face covering apparatus 10 generally comprises a flexible housing 12 that defines a pillow case and is U-shaped. The housing 12 includes a central portion 14 and a pair of arms 16 extending away from the central portion 14. The housing 12 has an elongated opening 18 therein to access interior of the housing 12. The housing 12 can be made of any conventional material used for pillow cases. The opening 18 is positioned in the central portion 14, opposite of the arms 16. A closure 20 is mounted on the housing 12 to selectively retain the opening 18 in a closed position. The closure 20 may comprise one or more buttons, a zipper or a hook and loop closure. Further, as shown in the Figures, the closure 20 may include a flap extendable over the opening 18. A pillow 22 is removably extended into the housing 12 through the opening 18. The pillow 22 may comprise an inflatable bladder for convenient storage purposes when not being used. Alternatively, the pillow 22 may comprise a cloth type shell filled with a resiliently compressible or down-like material. The pillow 22 will have the shape of the housing 12 to completely fill the housing. Alternatively, it should be understood that the housing 12 itself may define a pillow which is stuffed with the resiliently compressible material. A distance between the arms 16 may be less than 12 inches and each of the arms 16 may extend away from the central portion 14 less than 12 inches.

A flexible head covering 24 is attached to the housing 12 and extends upwardly therefrom. The head covering 24 includes a rear wall 26, a pair of lateral walls 28, and a top wall 30. It should be understood that the rear 26, lateral 22 and top 30 walls may be arcuate along their joined areas so that no definite distinction can be made as to a precise beginning and end of each of these walls with respect to each other. Additionally, as shown in the figures, the rear 26, lateral 28 and top 30 walls may be formed by the joining of two portions of cloth which ultimately form each of the above discussed walls. The top 30 and lateral 28 walls form a continuous front edge 32 defining an opening extending into a front side of the head covering 24. The rear 26 and lateral 28 walls are attached to the housing 12 so that the head covering 24 extends upwardly from the housing 12. In particular, the rear wall 26 is attached to the central portion 14 while the arms 16 each has one of the lateral walls 28 attached thereto. The connection is continuous so as to prevent any exposed apertures between the housing 12 and the head covering 24. The head covering 24 is comprised of a cloth material and any conventional cloth material may be used and will typically include those types of cloths used for blankets such as cotton, fleece, synthetic materials and combinations thereof. The head covering 24 will also be opaque to prevent the transmission of light flowing therethrough.

The head covering 24 will have an internal volume greater than 1.0 cubic feet to allow a person's face 50 to be encapsulated by the head covering 24 when the person abuts their head against the rear wall 26. As the purpose of the apparatus 10 is to allow a person to completely hide their face from the view of others and to completely shield their face 50 from persons sitting adjacent to them, it is felt that this size requirement, while much greater than a conventional jacket hood, is required to fulfill the purpose of the apparatus 10. In particular, the head cover 24 extends upwardly from the housing 12 a distance of at least 15 inches when pulled upwardly and measured from a plane of an upper surface of the housing to a central point of the top wall. A distance from the front edge to the rear wall is at least 14 inches measured along the outer surface of the head covering 24 from the front edge 32 to a central area of the rear wall 26. The head covering 24 should have sufficient size to allow the front edges 32 of the lateral walls 28 to be spaced from edge other at least 16 inches when the top wall 30 is extended 10 inches above the housing 12.

Figure 7:
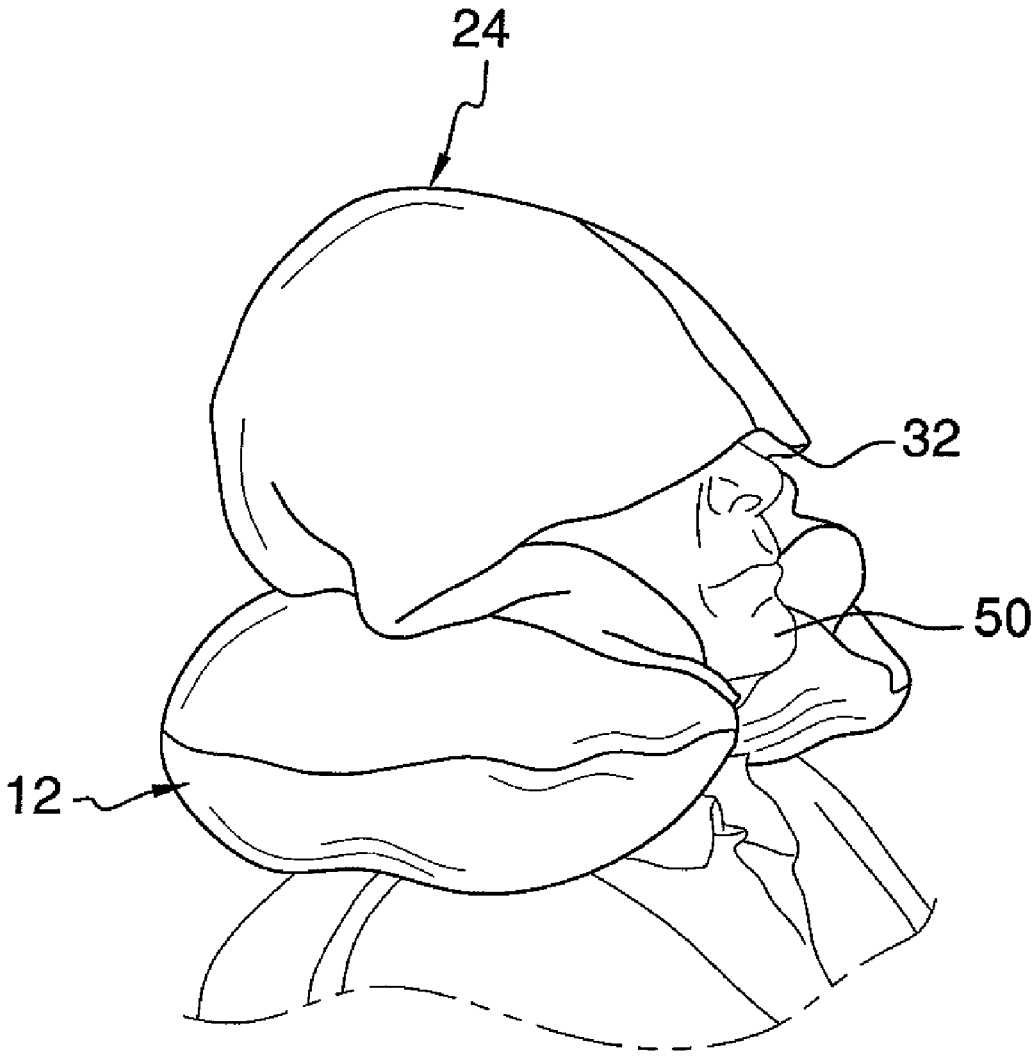
FIG. 7 is an in-use front perspective view of an embodiment of the disclosure.
Figure 8:
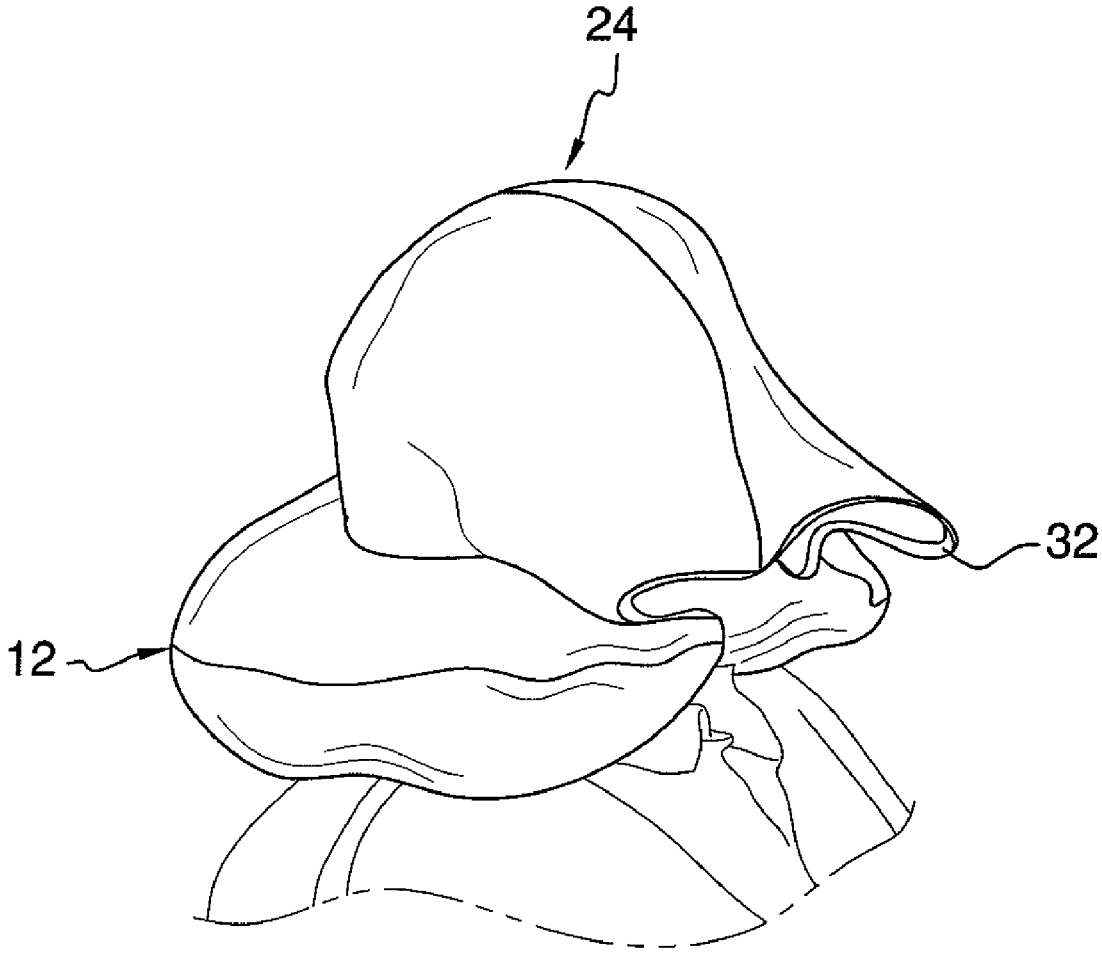
FIG. 8 is an in-use front perspective view of an embodiment of the disclosure.

In use, the housing 12 is filled with a pillow 22 and it positioned around the neck of the person to provide support for the neck and head of the person. The head covering 24 is then placed over the head of the person and may be used to either partially, as shown in FIG. 7, or fully, as shown in FIG. 8, cover the person's face 50. In some respects the head covering 24 will function as an oversized hood with the ability to protect a person's head from germs, provide privacy while sleeping and allow a person to determine to what extent their face is shielded from others while the person is traveling, particularly on a train, bus or airplane. Additionally, since the pillow 22 can be removed, the apparatus 10 is readily storable in a small space when not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A headrest and head shield assembly comprising:

a flexible housing defining a pillow case and being U-shaped, said housing including a central portion and a pair of arms extending away from said central portion, said housing having an elongated opening therein to access interior of said housing;

a pillow being removably extended into said housing through said opening; and a flexible head covering being attached to said housing and extending upwardly therefrom, said head covering including a rear wall, a pair of lateral walls, and a top wall, said top and lateral walls forming a continuous front edge defining an opening extending into a front side of said head covering, said rear and lateral walls being attached to said housing, said head covering having an internal volume greater than 1.0 cubic feet to allow a person's face to be encapsulated by said head covering when the person abuts their head against said rear wall, wherein each of said arms has one of said lateral walls attached thereto and said rear wall being attached to said central portion, and wherein said head cover extends upwardly from said housing a distance of at least 15 inches, a distance from said front edge to said rear wall being at least 14 inches, said head covering comprising a cloth material.

2. The assembly according to claim 1, wherein a distance between said arms is less than 12 inches, each of said arms extending away from said central portion less than 12 inches.

3. The assembly according to claim 1, wherein said pillow comprises an inflatable bladder.

* * * * *